US006942379B2

(12) United States Patent
Hardy

(10) Patent No.: US 6,942,379 B2
(45) Date of Patent: Sep. 13, 2005

(54) CLOCK ASSEMBLY HAVING AN ADJUSTABLE CONFIGURATION

(76) Inventor: John Hardy, P.O. Box 50, Ubud, Bali (ID)

( * ) Notice: Subject to any disclaimer, the term of this patent is extended or adjusted under 35 U.S.C. 154(b) by 131 days.

(21) Appl. No.: 10/139,698

(22) Filed: May 3, 2002

(65) Prior Publication Data

US 2003/0206498 A1 Nov. 6, 2003

(51) Int. Cl.[7] ..... G04B 37/00
(52) U.S. Cl. ..... 368/276; 368/285
(58) Field of Search ..... 368/276, 277, 368/223, 285, 297, 298, 327, 316

(56) References Cited

U.S. PATENT DOCUMENTS 4,033,111 A * 7/1977 Matsuura ..... 368/293
4,317,188 A * 2/1982 Ushikoshi ..... 368/293
4,725,061 A * 2/1988 Gross ..... 273/157 R
4,897,825 A * 1/1990 Ikenishi ..... 368/228
5,375,102 A * 12/1994 Schiavolini ..... 368/10
5,646,913 A * 7/1997 Quesenberry ..... 368/223
5,754,499 A * 5/1998 Lin ..... 368/88
6,278,664 B1 * 8/2001 Huffman et al. ..... 368/223
6,382,625 B1 * 5/2002 Chang ..... 273/160

* cited by examiner

*Primary Examiner*—Kamand Cuneo
*Assistant Examiner*—Jeanne-Marguerite Goodwin
(74) *Attorney, Agent, or Firm*—Schiff Hardin LLP

(57) ABSTRACT

The present invention provides a modular clock assembly comprising a body portion having a clock face and an exterior surface extending peripherally around the clock face, a clock mechanism secured to the body portion, a clock magnet affixed to the exterior surface of the body portion, a moveable member having a plurality of member surfaces, and at least one member magnet affixed to a member surface so that the moveable member is attachable to the exterior surface of the body portion by aligning the member magnet with the clock magnet.

35 Claims, 3 Drawing Sheets

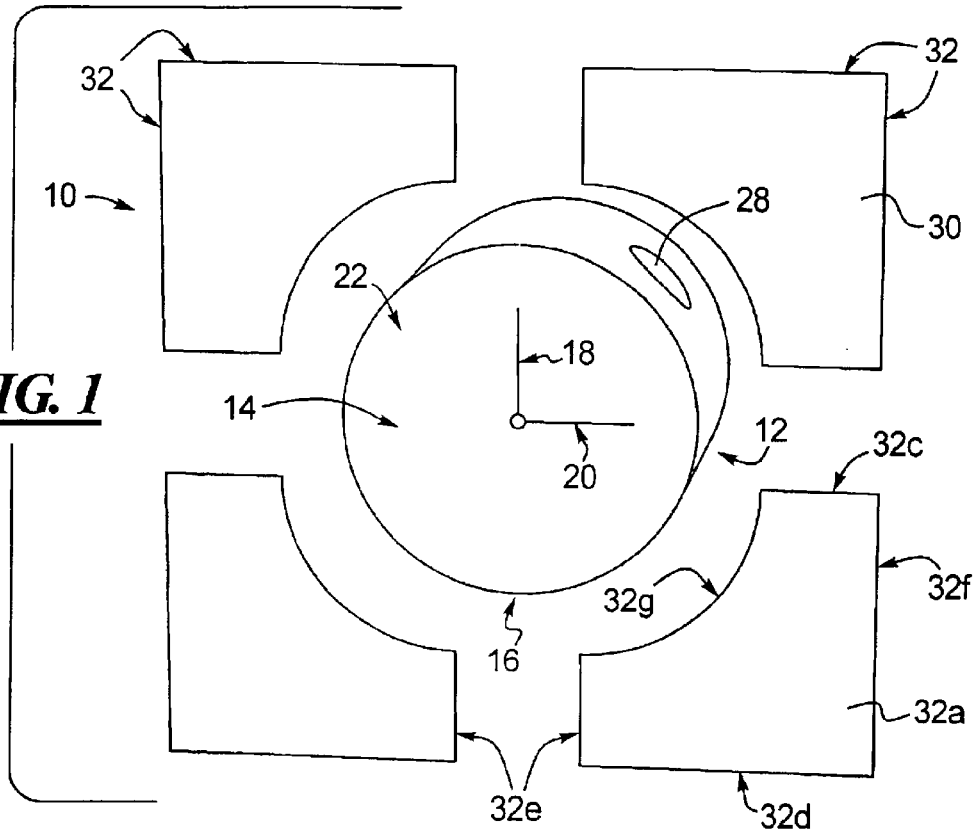
FIG. 1
FIG. 2
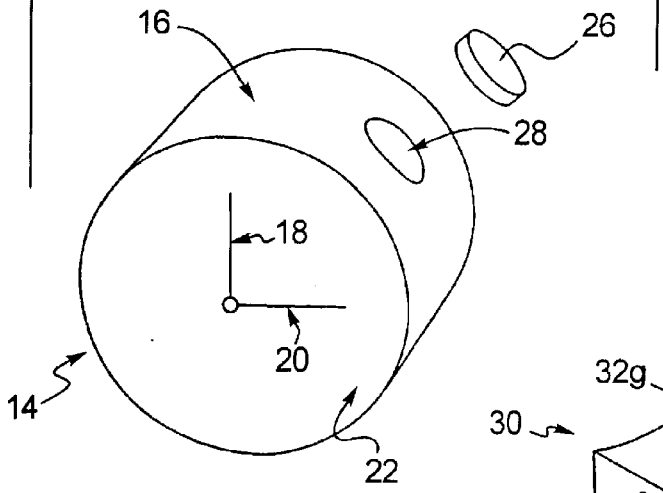
FIG. 3
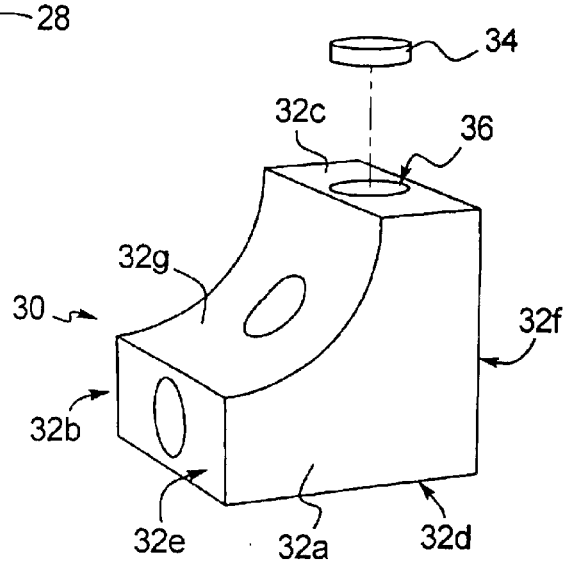

CLOCK ASSEMBLY HAVING AN ADJUSTABLE CONFIGURATION

FIELD OF THE INVENTION

The present invention relates to the field of clocks, and more particularly but not by way of limitation to an improved modular clock assembly.

BACKGROUND OF THE INVENTION

Many different types of clocks are available in the market today. Most conventional clocks are constructed in such a manner that their shapes are fixed or rigid.

The use of magnets to secure movable parts of clocks is known. For example, U.S. Pat. No. 5,375,102 issued to Schiavolini discloses a clock having an interchangeable decorative member which may be mounted directly on top of a fixed glass member on the clock or watch so that it is possible to repeatedly change the appearance of the clock. The patent teaches a securing means which includes a plurality of magnets. U.S. Pat. No. 5,646,913 issued to Quesenberry discloses a teaching clock with removable repositionable pieces for representing different periods of time. The patent teaches that the removable pieces may be attachably fastened to the recessed area of the dial plate of the clock by means of a magnetic type fastener.

None of the prior art cited above disclose a clock assembly having magnetically moveable members that can be configured such that the entire clock assembly takes a different shape and form.

Therefore, a need remains for a clock assembly with moveable magnetically attachable members that provide a modular configuration for a clock assembly.

SUMMARY OF THE INVENTION

The present invention provides a modular clock assembly comprising a body portion having a clock face and an exterior surface extending peripherally around the clock face. A clock mechanism is secured to the body portion. A clock magnet is affixed to the exterior surface of the body portion. The clock assembly further comprises a moveable member. The moveable member has a plurality of member surfaces. At least one member magnet is affixed to one of the member surfaces so that the moveable member is attachable to the exterior surface of the body portion by aligning the member magnet with the clock magnet. Therefore, the moveable member may be arranged about the exterior surface to provide a modular clock assembly.

These and various other features as well as advantages which characterize the present invention will be apparent from a reading of the following detailed description and a review of the associated drawings.

BRIEF DESCRIPTION OF THE DRAWINGS

FIG. 1 shows an exploded view of a first embodiment of the clock assembly of the present invention.

FIG. 2 shows an exploded view of the body portion and the corresponding clock magnet of the clock assembly of FIG. 1.

FIG. 3 shows a perspective view of the moveable member of the clock assembly of FIG. 1.

DETAILED DESCRIPTION OF THE INVENTION

Figure 4:
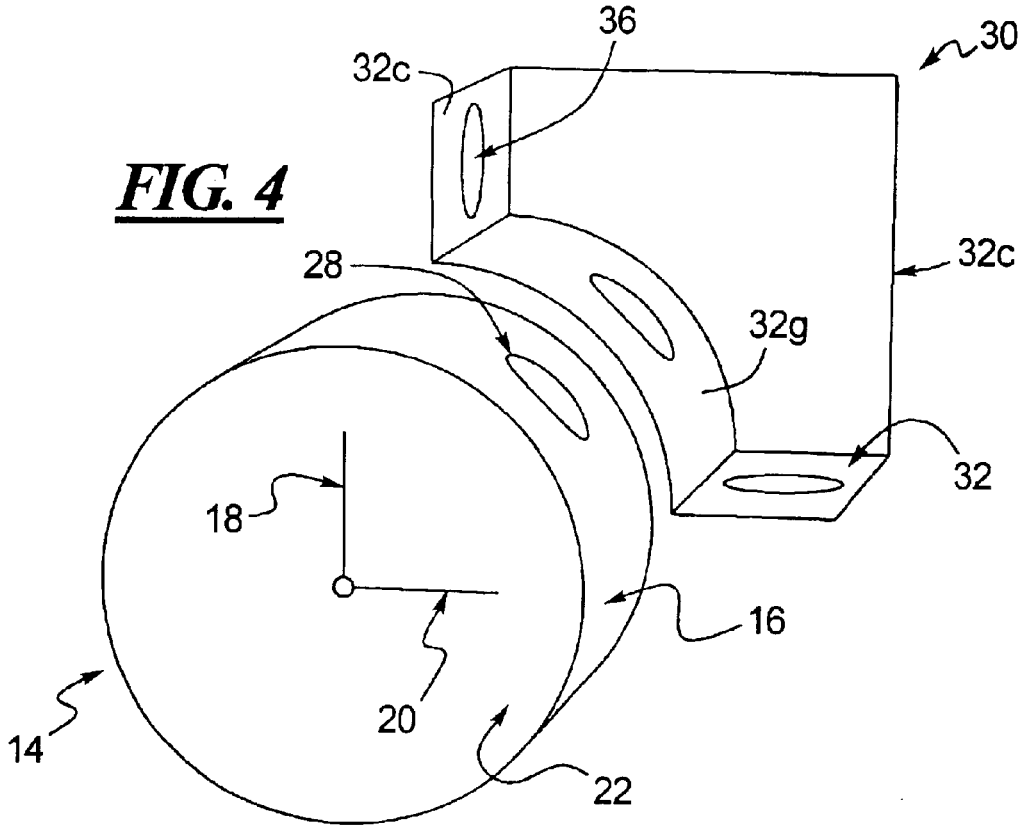
FIG. 4 shows an exploded view of the moveable member and the body portion of the clock assembly of FIG. 1.

Referring now to the drawings, and more particularly to FIG. 1, shown therein is a first embodiment of the present invention. As shown in FIG. 1, the present invention includes a clock assembly 10. The clock assembly 10 comprises a body portion 12. The body portion 12 has a clock face 14 and an exterior surface 16 extending peripherally around the clock face 14. The clock face 14 has an hour hand 18 and a minute hand 20. It should be noted that the clock face 14 is not limited to a particular shape so that the exterior surface 16 extends peripherally, or around the border, of any shape of the clock face 14. For example, the clock face 14 may be round, square or oval, with an exterior surface 14 configured to extend peripherally about each shape. A cover 22 is configured to enclose the clock face 14. Any means known to persons of ordinary skill in the art may be used to affix the cover 22 to the clock face 14. Further, the cover 22 may be constructed from any material known to persons of ordinary skill in the art.

Secured to the body portion 12 is a clock mechanism 24 (not shown) for controlling the functioning of the clock assembly 10. The clock mechanism 24 may be attached by any means known to persons of ordinary skill in the art. In the preferred embodiment, the clock mechanism 24 is positioned within the body portion 12. The present invention is not limited to the type of clock mechanism 24 positioned within the body portion 12 of the clock assembly 10. In the preferred embodiment of the present invention, the clock mechanism 24 is conventional.

Turning to FIG. 2, shown therein is an exploded view of the body portion 12 and a corresponding clock magnet 26 of the clock assembly 10 of FIG. 1. In particular, shown therein is a clock magnet 26 affixable to the exterior surface 16 of the body portion 12. The clock magnet 26 may be affixed to the exterior surface 16 through means known to persons of ordinary skill in the art, such as through the use of glue. It should be noted that the exterior surface 16 can have more than one clock magnet 26 affixed thereto.

In the preferred embodiment, a liner can be placed between the clock mechanism 24 and the clock magnet 26 of the clock assembly 10 in order to shield the clock mechanism 24 from magnetic field disturbances and to inhibit magnetic disorientation of the clock mechanism 24. Suitable materials for the liner include materials having high magnetic permeability such as Mumetal® and Permalloy C®, typically available from companies such as Goodfellow Supply, The liner may be utilized in a number of configurations including, but not limited to: directly enclosing the clock mechanism 24, attached to the inside of the clock body 12, within the material comprising the clock body 12 or surrounding all sides of the clock magnet 26 which are attached to the clock body 12. It should be noted that in an alternative embodiment, there may be multiple liners attached to the clock assembly 10 by methods known by those skilled in the art.

In the preferred embodiment, the exterior surface 16 defines an exterior surface aperture 28, preferably a plurality of exterior surface apertures 28, and most preferably four exterior surface apertures 28 arranged about the periphery of the exterior surface 16. Each exterior surface aperture 28 has a corresponding clock magnet 26 disposed therein. In the preferred embodiment, the exterior surface apertures 28 of the exterior surface 16 are equally spaced about the exterior surface 16. However, it should be noted that it is contemplated to be within the scope of the invention to have various spacings between the exterior surface apertures 28 to provide for the modular configurations of the clock assembly 10.

Further, each of the exterior surface apertures 28 is configured to receive the corresponding clock magnet 26, as shown in FIG. 2. Specifically, the exterior surface aperture 28 envelops the clock magnet 26 to hold the clock magnet 26 securely therein. In the present invention, the exterior surface aperture 28 may be of various configurations as desired by persons of ordinary skill in the art. In particular, the exterior surface aperture 28 may be square, rectangular, or round, with a corresponding clock magnet 26 configured to securely fit therein. In the preferred embodiment, each exterior surface aperture 28 is round with a corresponding round clock magnet 26. It should be noted that it is within the scope of the present invention to have each exterior surface aperture 28 of a different configuration.

Turning to FIG. 3, shown therein is a perspective view of the moveable member 30 of the clock assembly 10. In the present invention, the clock assembly 10 has at least one moveable member 30, preferably a plurality of moveable members 30, and most preferably between two to four moveable members 30. Each moveable member 30 has a plurality of member surfaces 32 and a configuration that is suitable for affixing at least one member surface 32 to the exterior surface 16 of the body portion 12. The configuration of the moveable member 30 may vary as desired by one of ordinary skill in the art, but preferably the configuration is square, rectangular or L-shaped, and most preferably the configuration is L-shaped. Specifically, as shown in FIG. 3, each moveable member 30 has a front and back member surface, 32*a* and 32*b*, respectively, a top and bottom member surface, 32*c* and 32*d*, respectively, two side member surfaces, 32*e* and 32*f*, respectively, and a concave member surface 32*g* disposed between the top member surface 32*c* and either the first or second side member surfaces, 32*e* or 32*f*, respectively. In the preferred embodiment, each of the member surfaces 32 have at least one corresponding member magnet 34 affixed thereto. In a particularly preferred embodiment, the top member surface 32*c*, bottom member surface 32*d*, two side member surfaces, 32*e* and 32*f*, and the concave member surface 32*g* each have a member magnet 34 affixed thereto. However, it should be noted that it is within the scope of the present invention to have any disposition of member magnets 34 within the member surfaces 32 as long as at least one member surface 32 has one member magnet 34.

Each member magnet 34 may be affixed to the corresponding member surface 32 by any method known to persons of ordinary skill in the art such as through the use of glue or similar fixing compounds. In the preferred embodiment, each member surface 32 defines a member aperture 36. Each of the member apertures 36 is configured to receive the corresponding member magnet 34. The member aperture 36 envelops the member magnet 34 to hold the member magnet 34 securely therein. In the preferred embodiment, each member aperture 36 is defined in a center of each of the member surfaces 32. However, it should be noted that it is within the scope of the present invention to provide member apertures 36 in other arrangements as desired by persons of ordinary skill in the art.

In the present invention, each member aperture 36 may be of various configurations as desired by persons of ordinary skill in the art. In particular, each member aperture 36 may be square, rectangular, or round with a corresponding member magnet 34 configured to fit securely therein. In the preferred embodiment, each member aperture 36 is round with a corresponding round member magnet 34 to fit therein. It should be noted that it is within the scope of the present invention to have each member aperture 36 of a different configuration.

Figure 5:
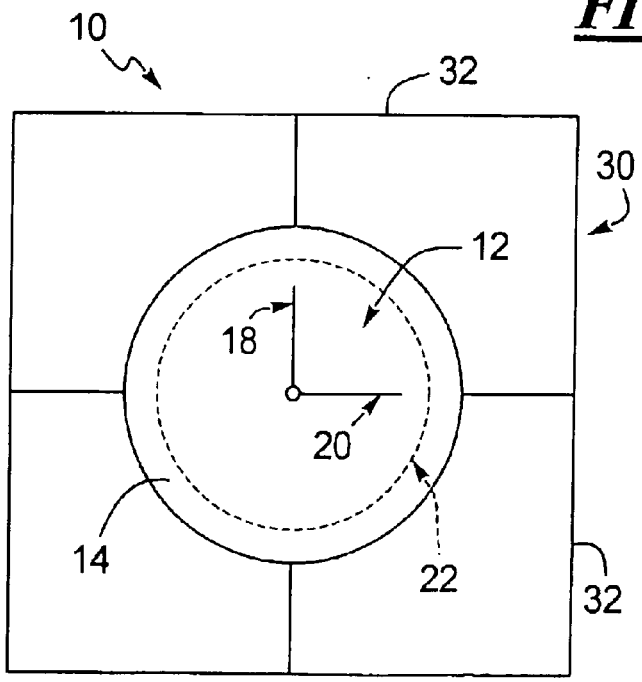
FIG. 5 shows a preferred embodiment of the clock assembly of FIG. 1.

Each moveable member 30 is fixable to the exterior surface 16 of the body portion 12 of the clock assembly 10 by aligning the clock magnet 26 with one member magnet 34, as shown in FIG. 4. Any one of the clock magnets 26 may therefore be magnetically coupled to any member magnet 34 in any of the member surfaces 32 to provide for the modular configuration of the clock assembly 10. In a preferred embodiment, a plurality of members 30 may be joined together by aligning each of the member magnets 34, thereby forming an adjustable configuration around the exterior surface 16 of the body portion 12 resulting in the clock assembly 10 of FIG. 1. As shown in FIG. 5, the moveable members 30 may be adjusted to form a frame as well as a support for the body portion 12 of the clock assembly 10.

Figure 6:
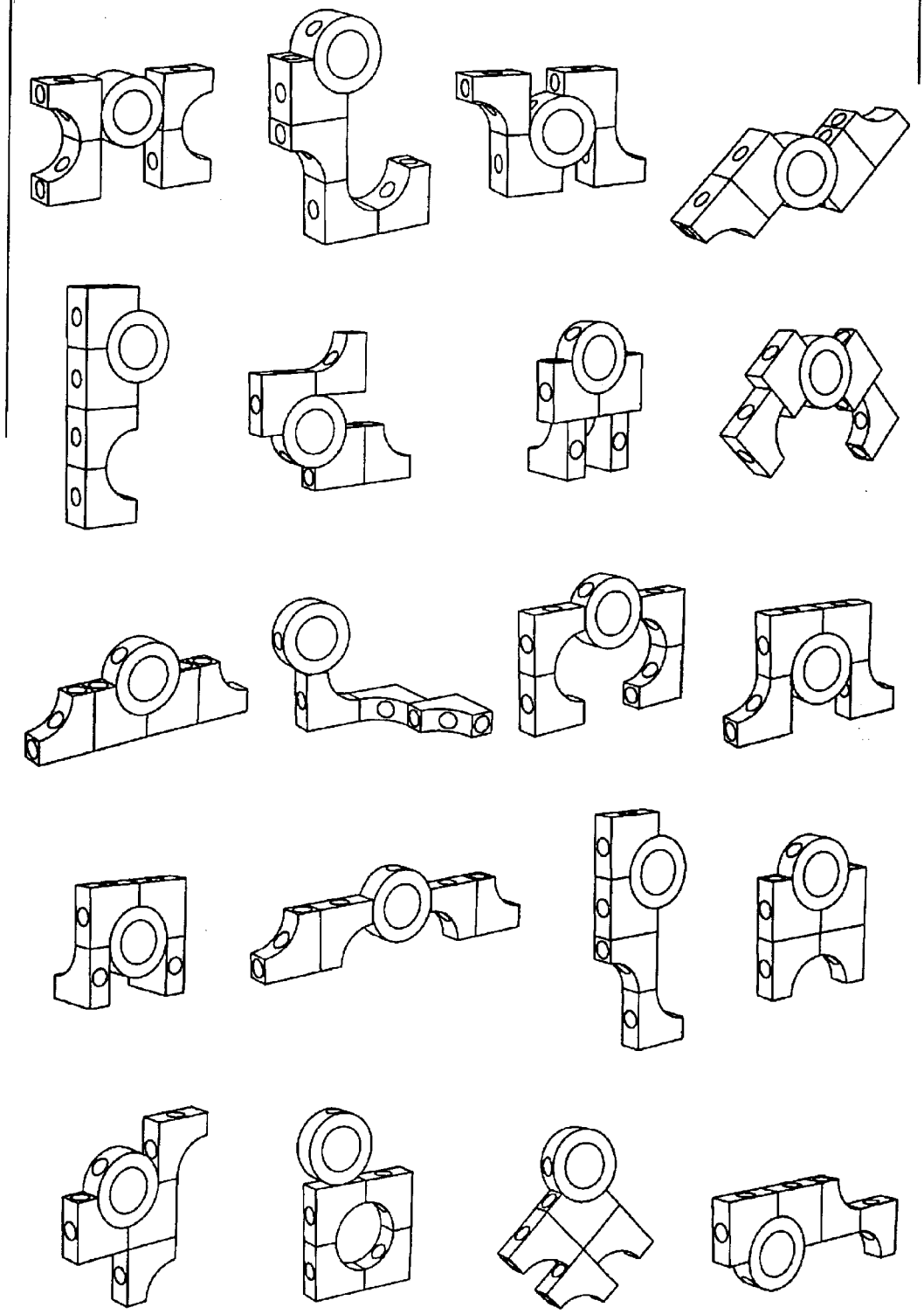
FIG. 6 shows alternative configurations of the clock assembly of the present invention.

In alternative embodiments, the moveable members 30 may be attached to the exterior surface 16 of the body portion 12 in a number of configurations including, but not limited to, those shown in FIG. 6.

It will be clear that the present invention is well adapted to carry out the objects and attain the ends and advantages mentioned as well as those inherent therein. While presently preferred embodiments have been described for purposes of this disclosure, numerous changes may be made which will readily suggest themselves to those skilled in the art and which are encompassed in the spirit of the invention disclosed and as defined in the appended claims.

What is claimed is:

1. A clock assembly comprising:

(a) a body portion having a clock face and an exterior surface extending peripherally around the clock face;

(b) a clock mechanism secured to the body portion;

(c) a plurality of clock magnets affixed to the exterior surface of the body portion;

(d) a moveable member having a plurality of member surfaces; and (e) at least one member magnet affixed to at least one of the member surfaces so that the moveable member is attachable to the exterior surface of the body portion by aligning the at least one member magnet with any of the clock magnets, thereby providing for a modular configuration for the clock assembly, wherein the exterior surface of the body portion defines at least one exterior surface aperture configured to receive the clock magnet.

2. The clock assembly of claim 1 wherein the clock face is round.

3. The clock assembly of claim 1 wherein the clock face is square.

4. The clock assembly of claim 1 wherein the clock face is oval.

5. The clock assembly of claim 1 wherein the at least one of the member surfaces defines at least one member aperture configured to receive the at least one member magnet therein.

6. The clock assembly of claim 5 wherein the at least one member aperture is defined in a center of the at least one of the member surfaces

7. The clock assembly of claim 5 wherein the exterior surface of the body portion defines a plurality of exterior surface apertures, each of the exterior surface apertures configured to receive a corresponding clock magnet so that any one of the clock magnets can be magnetically coupled to the member magnet in at least one of the member surfaces to provide a modular configuration for the clock assembly.

8. The clock assembly of claim 7 further comprising a plurality of moveable members, each moveable member having at least one member magnet so that each moveable member is attachable to the exterior surface of the body portion of the clock assembly by aligning each member magnet with a corresponding clock magnet.

9. The clock assembly of claim 8 wherein each of the plurality of moveable members may be coupled together by aligning each of the member magnets, thereby forming a modular configuration around the exterior surface of the body portion of the clock assembly.

10. The clock assembly of claim 9 wherein the moveable members may be adjusted to form a frame for the body portion.

11. The clock assembly of claim 1 wherein the moveable member has a configuration that is suitable for affixing to the exterior surface of the body portion.

12. The clock assembly of claim 11 wherein the configuration of the moveable member is square.

13. The clock assembly of claim 11 wherein the configuration of the moveable member is rectangular.

14. The clock assembly of claim 11 wherein the configuration of the moveable member is L-shaped.

15. The clock assembly of claim 1 further comprising a plurality of exterior surface apertures, of the exterior surface of the body portion are equally spaced about the exterior surface.

16. The clock assembly of claim 1 wherein the at least one exterior surface aperture is square and the corresponding clock magnet is square to fit therein.

17. The clock assembly of claim 16 wherein the at least one member surface comprises a member aperture, and wherein the member aperture is square and the at least one member magnet is square to fit therein.

18. The clock assembly of claim 1 wherein the at least one exterior surface aperture is rectangular and the corresponding clock magnet is rectangular to fit therein.

19. The clock assembly of claim 18 wherein the at least one member surface comprises a member aperture, and wherein the member aperture is rectangular and the at least one member magnet is rectangular to fit therein.

20. The clock assembly of claim 1 wherein the at least one exterior surface aperture is round and the corresponding clock magnet is round to fit therein.

21. The clock assembly of claim 20, wherein the at least one member surface comprises a member aperture, and wherein the member aperture is round and the at least one member magnet is round to fit therein.

22. A clock assembly comprising:

(a) a body portion having a clock face and an exterior surface extending peripherally around the clock face;

(b) a clock mechanism secured to the body portion;

(c) a plurality of clock magnets affixed to the exterior surface of the body portion;

(d) a moveable member having a plurality of member surfaces; and (e) at least one member magnet affixed to at least one of the member surfaces so that the moveable member is attachable to the exterior surface of the body portion by aligning the at least one member magnet with any of the clock magnets, thereby providing for a modular configuration for the clock assembly, wherein the clock face is round, and wherein the moveable member has a front member surface, a back member surface, a top member surface, a bottom member surface, two side member surfaces and a concave member surface disposed between the top member surface and one of the side member surfaces so that the concave member surface fits securely over the round clock face.

23. The clock assembly of claim 22 wherein the top member surface, the bottom member surface, the two side member surfaces and the concave member surface each have a member magnet affixed to the member surface.

24. A modular clock assembly comprising:

(a) a body portion having a clock face and an exterior surface extending peripherally around the clock face;

(b) a clock mechanism secured to the body portion;

(c) a plurality of clock magnets affixed to the exterior surface of the body portion a plurality of (d) a moveable member having a plurality of member surfaces; and (e) at least one member magnet and a corresponding member aperture defined within a member surface so that the member magnet is disposed within the member surfaces, the moveable member being attachable to the exterior surface of the body portion by aligning any member magnet with any of the clock magnets, thereby providing for a modular configuration for the clock assembly.

25. The clock assembly of claim 24 wherein the exterior surface of the body portion defines a plurality of exterior surface apertures, with each of the exterior surface apertures being configured to receive a corresponding clock magnet so that any one of the clock magnets can be magnetically coupled to the member magnet in the member surface to provide a modular configuration for the clock assembly.

26. The clock assembly of claim 25 further comprising a plurality of moveable members, each moveable member having at least one member magnet so that each moveable member is attachable to the exterior surface of the body portion of the clock assembly by aligning each member magnet with a corresponding clock magnet.

27. The clock assembly of claim 26 wherein each of the plurality of moveable members may be coupled together by aligning each of the member magnets, thereby forming a modular configuration around the exterior surface of the body portion of the clock assembly.

28. The clock assembly of claim 27 wherein each of the exterior surface apertures of the exterior surface of the body portion are equally spaced about the exterior surface.

29. The clock assembly of claim 27 wherein the exterior surface aperture is round and the corresponding clock magnet is round to fit therein.

30. The clock assembly of claim 29 wherein the member aperture is round and the corresponding member magnet is round to fit therein.

31. The clock assembly of claim 24 wherein the moveable member has a configuration that is suitable for affixing to the exterior surface of the body portion.

32. The clock assembly of claim 31 wherein the moveable member has a front member surface, a back member surface, a top member surface, a bottom member surface, two side member surfaces and a concave member surface disposed between the top member surface and one of the side member surfaces.

33. A modular clock assembly comprising:

(a) a body portion having a clock face and an exterior surface extending peripherally around the clock face;

(b) a clock mechanism secured to the body portion;

(c) a plurality of clock magnets and corresponding exterior surface apertures defined in the exterior surface so that the each clock magnet is disposed within each exterior surface aperture of the body portion;

(d) a plurality of moveable members, each having a plurality of member surfaces; and (e) a plurality of member magnets and corresponding member apertures defined within each member surface so that each member magnet is disposed within each member surface, whereby each moveable member is attachable to the exterior surface of the body portion by aligning any member magnet with any of the clock magnets and each moveable member is attachable to each other by aligning each of the member magnets, thereby providing a modular configuration for the clock assembly.

34. The clock assembly of claim 33 wherein each of the exterior surface apertures of the exterior surface of the body portion are equally spaced about the exterior surface.

35. The clock assembly of claim 33 wherein the moveable member has a front member surface, a back member surface, a top member surface, a bottom member surface, two side member surfaces and a concave member surface disposed between the top member surface and one of the side member surfaces.

* * * * *